United States Patent [19]

Solomko

[11] Patent Number: 4,766,698

[45] Date of Patent: Aug. 30, 1988

[54] APPARATUS FOR FINISHING THE FACE OF THE HEAD OF A GOLF CLUB WOOD

[76] Inventor: Alexander Solomko, 908 Sanderson St., Throop, Pa. 18412

[21] Appl. No.: 121,130

[22] Filed: Nov. 16, 1987

[51] Int. Cl.[4] ..... B27M 3/22; B24B 9/00

[52] U.S. Cl. ..... 51/96; 144/2 XA; 273/167 R

[58] Field of Search ..... 273/167 R, 167 G, 174; 51/96; 144/2 XA; 33/502, 508

[56] References Cited

U.S. PATENT DOCUMENTS 3,022,610 2/1962 Barrett ..... 51/96

3,908,722 9/1975 Jacobs ..... 144/2 XA 4,123,060 10/1978 Sterling ..... 273/174

4,633,617 1/1987 vanDijk ..... 51/96

*Primary Examiner*—W. Donald Bray

*Attorney, Agent, or Firm*—Joseph W. Molasky & Assocs.

[57] ABSTRACT

An apparatus for finishing the face of the head of a golf club wood is constructed to form a preset bulge and roll face curvatures on the head face simultaneously. The head of a golf club wood is held on a jig member pivotally monted for movement through a circular arc and guided for movement toward a sanding member to present the head face into contact with a concave sanding surface for finishing the head face with preset bulge and roll face curvatures.

18 Claims, 4 Drawing Sheets

FIG. 1
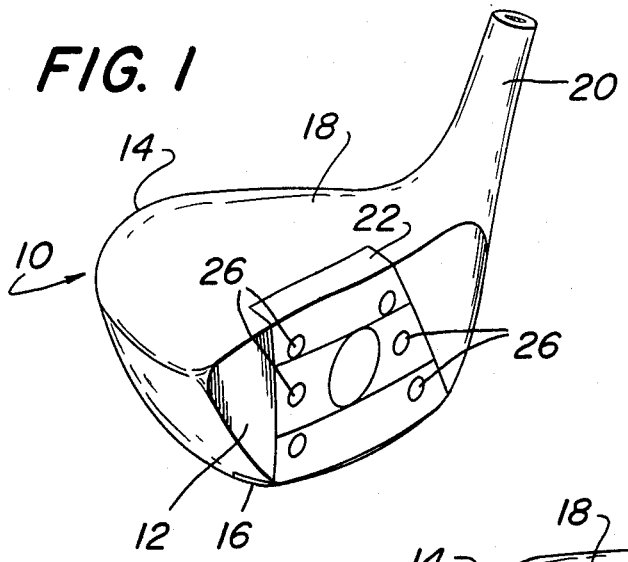
FIG. 2
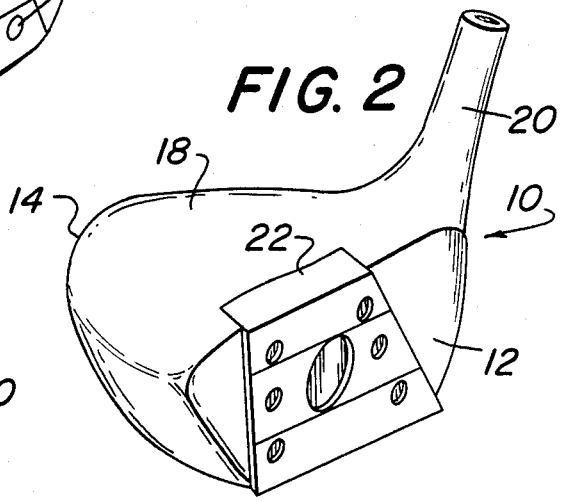
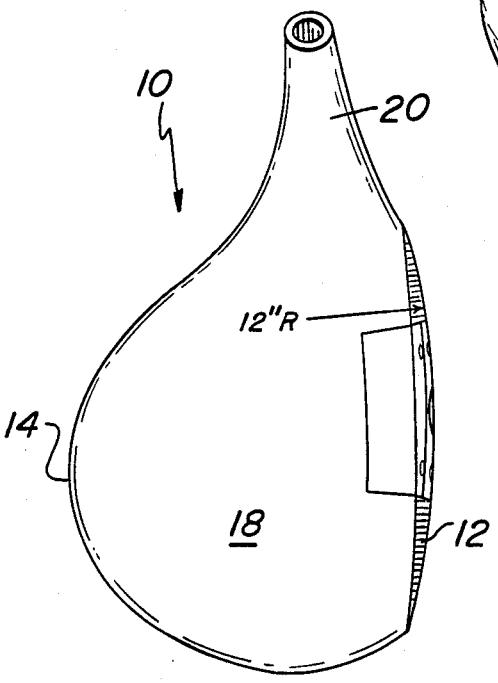
FIG. 3
FIG. 4
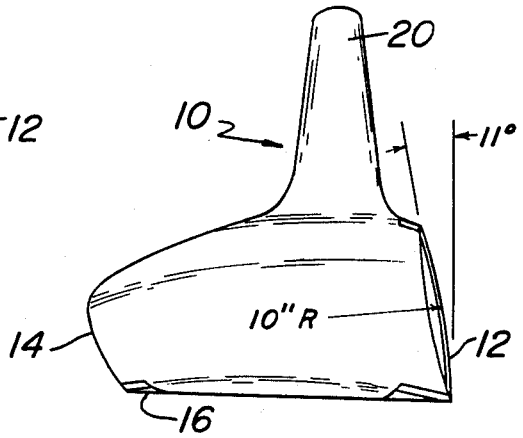

FIG. 5
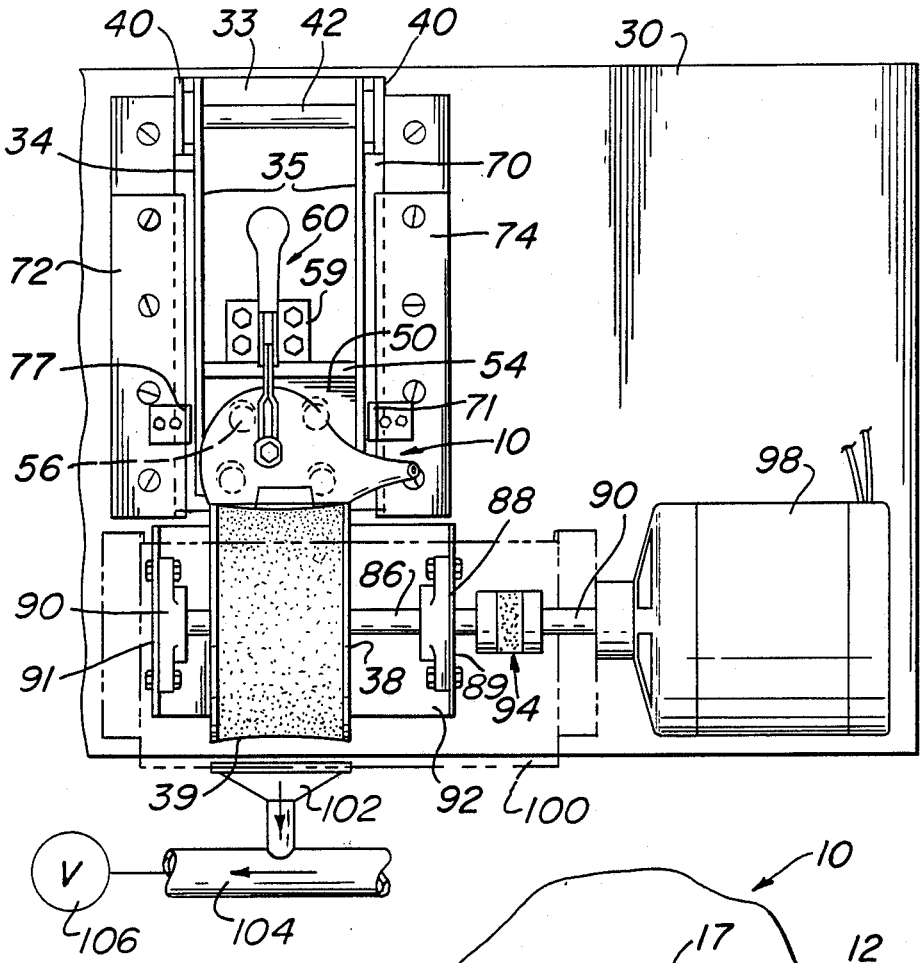
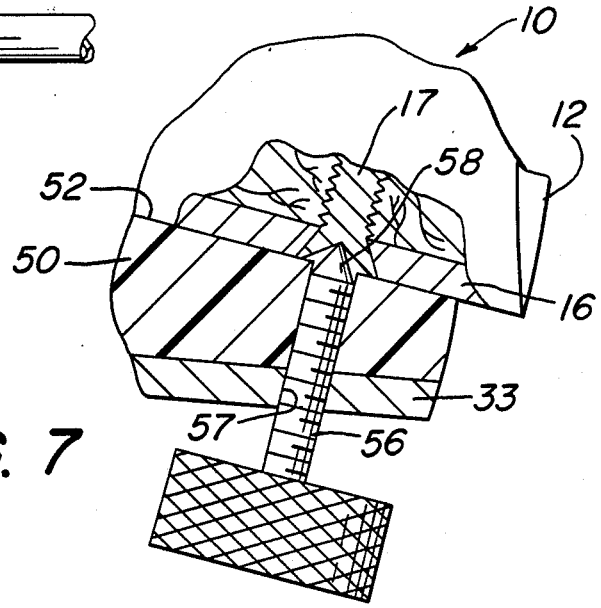
FIG. 7

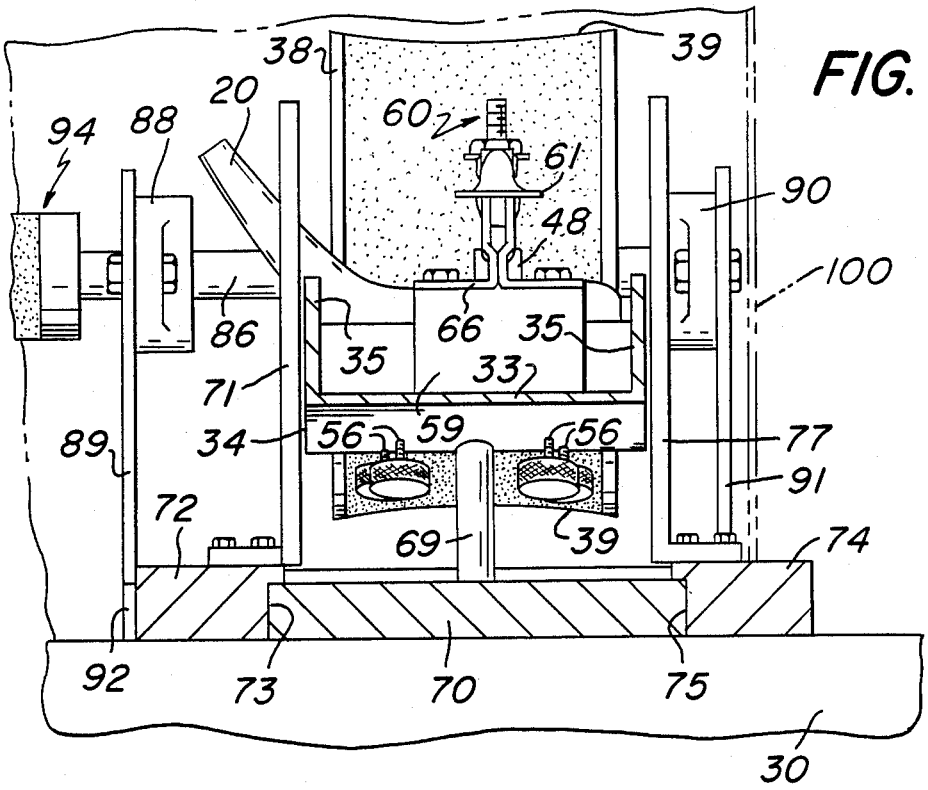
FIG. 8
FIG. 9
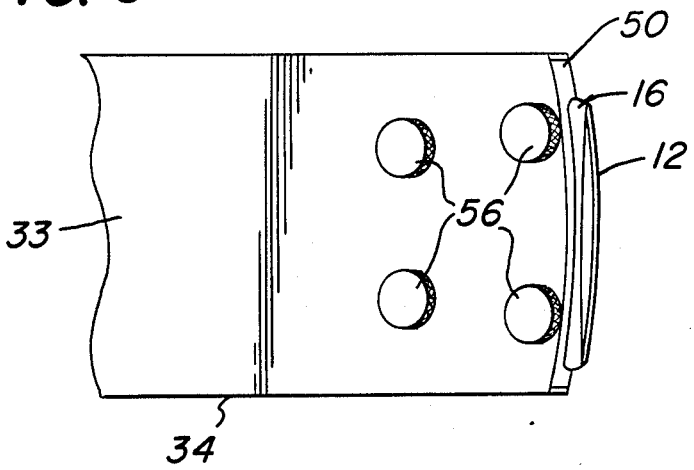

APPARATUS FOR FINISHING THE FACE OF THE HEAD OF A GOLF CLUB WOOD

BACKGROUND OF THE INVENTION

1. Field of the Invention

This invention relates generally to the field of making golf club woods. More particularly, the invention relates to the finishing of the face of the head of a golf club wood.

The heads of golf club woods are of the same general well known shape with a ball striking face at one end and a toe at the other end with a metallic sole plate extending along the bottom of the head between the face and toe. With the sole plate positioned to extend horizontally along the ground, the face extends upwardly from the sole plate at an angle to the perpendicular known as the loft angle. In addition, the face is formed with two curvatures, namely, a bulge curvature, extending on a radius of curvature across the face in a generally horizontal direction, and a roll curvature, extending across the face in a vertical direction. The bulge and roll face curvatures are well known, a typical radius of curvature for the bulge face curvature being twelve inches and a typical radius of curvature for the roll face curvature being ten inches.

It will be apparent that the finishing of the face of the head of a golf club wood with the two curvatures, i.e., the bulge and roll face curvatures, and the proper loft angle is difficult to achieve with a high degree of accuracy.

2. Description of the Prior Art

The present-day method of finishing the face of the head of a golf club wood with bulge and roll face curvatures is by means of a hand operation. The wood face is filed by hand with repeated checking of the radii as the filing procedure is carried out.

This hand filing method of the prior art is not satisfactory. It is time consuming and often it is not possible to achieve the desired curvatures with the required accuracy.

SUMMARY OF THE INVENTION

It is the general object of this invention to provide an apparatus for finishing the face of the head of a golf club wood with preset desired bulge and roll face curvatures. The desired bulge and roll radii are preset in the apparatus so that it is possible to achieve the desired bulge and roll face curvatures with a high degree of accuracy.

Briefly stated, the general object of the invention is achieved by an apparatus which comprises a base, a jig means movably mounted on the base and having a jig member mounted for movement therewith and pivotally mounted thereon. The head of the golf club wood is held in a fixed position on the jig member at a free end thereof so that the face of the head is movable through a circular arc centered on the pivotal axis which has a predetermined radius. The apparatus comprises means for sanding the face of the head as it moves through the circular arc, said means including a rotating sanding member mounted for rotation about an axis of rotation and having a concave sanding surface of a predetermined radius of curvature. There is provided means for guiding the jig means for movement on the base toward the sanding member to present the head face into contact with the concave sanding surface for finishing the wood surface with bulge and roll face curvatures.

The desired radii are preset in the apparatus since the radius of curvature of the concave sanding surface is equal to the radius of curvature of the desired bulge face curvature of the head of the golf club wood and the radius of the circular arc through which the head face is movable on the jig member is equal to the radius of curvature of the desired roll face curvature of the head of the golf club wood.

BRIEF DESCRIPTION OF THE DRAWINGS

FIG. 1 is a perspective view of the head of a golf club wood in a finished condition.

FIG. 2 is a perspective view of the head shown in FIG. 1 in a condition prior to the finishing operation of the apparatus in accordance with the invention.

FIG. 3 is a plan view of the head shown in FIG. 1 illustrating the bulge face curvature thereof.

FIG. 4 is a front elevational view of the head shown in FIG. 1 and illustrating the loft angle and the roll face curvature thereof.

FIG. 5 is a plan view of the apparatus in accordance with the invention.

FIG. 7 is a fragmentary view of a detail of the apparatus shown in FIG. 6.

FIG. 8 is a sectional view taken on line 8—8 of FIG. 6.

FIG. 9 is a fragmentary sectional view taken on line 9—9 of FIG. 6.

DETAILED DESCRIPTION OF THE PREFERRED EMBODIMENT

Figure 6:
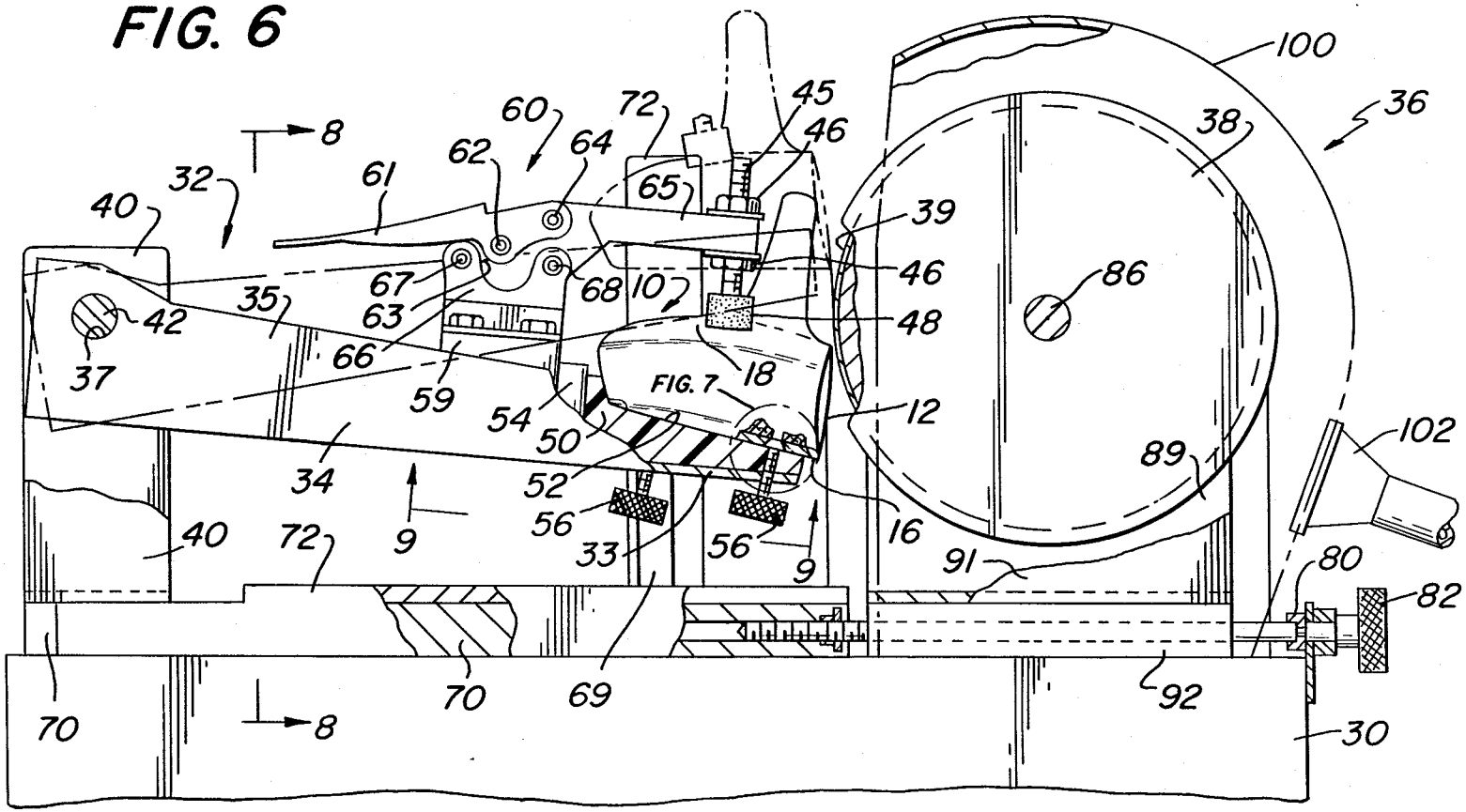
FIG. 6 is a side elevational view of the apparatus shown in FIG. 5.

Referring to FIGS. 1–4, there is shown the head 10 of a golf club wood, namely, the head shown is a "No. 1" wood. The finished head 10 is provided with a ball striking face 12 at one end and a toe 14 at the other end, with a metallic sole plate 14 extending along the bottom of head 10 between the face 12 and toe 14. The top 18 of head 10 that is opposite sole plate 16 has a generally rounded configuration, as is shown in FIGS. 1–4. Head 10 is also provided with a stem portion 20, which is adapted to be connected to the shaft of the golf club wood, as is conventional. Head 10 is made of a hard wood, such as aged persimmon, except for an insert 22 made of a hard material, such as a phenolic resin or a hard fiber. The insert 22 is held in a recess formed in the face 12 by six screws 26 which are ground so that they are flush with the surface of insert 22, as will be described hereafter. The insert 22 is initially held in position by an epoxy glue.

In FIGS. 3 and 4 the head 10 is shown with the sole plate 16 positioned to extend horizontally along the ground. FIG. 4 shows the loft angle of eleven degrees to the perpendicular which is typical for a "No. 1" wood that produces a normal ball trajectory. FIG. 3 shows the desired bulge curvature, which extends on a radius of curvature of twelve inches across the face 12 in a generally horizontal direction. FIG. 4 illustrates the desired roll curvature, which extends on a radius of ten inches across the face 12 in a generally vertical direction.

In FIGS. 5–9 there is shown an apparatus in accordance with the invention for finishing the face of the head 10 to form preset bulge and roll face curvatures of twelve inches and ten inches, respectively, on the head face 12.

The apparatus in accordance with the invention comprises a horizontally extending base 30, a jig means 32 movably mounted on base 30 and having a jig member 34 pivotally mounted thereon for movement about a horizontal pivotal axis and means for holding the head 10 of a golf club wood in a fixed position at a free end of the jig member 34 so that the face 12 of the head 10 is movable through a circular arc centered on said pivotal axis and having a predetermined radius, and sanding means 36 for sanding the face 12 of the head 10 as it moves through said circular arc including a rotating sanding member 38 mounted for rotation about a horizontal axis of rotation parallel to said pivotal axis.

Jig member 34 is comprised of a U-shaped channel member which is pivotally mounted at one end and extends from its pivoted end a substantial distance to a free end located adjacent sanding member 38. There are provided means for mounting jig member 34 on the jig means 32 for pivotal movement about a horizontally extending pivotal axis. Such means comprises a pair of spaced apart upright members 40 mounted at their lower ends on a horizontal carriage 70 to extend vertically upwardly therefrom to support a horizontally extending pivot pin 42. Jig member 34 is pivotally mounted on pivot pin 42 for movement about a horizontally extending pivotal axis, i.e., the axis of pivot pin 42. This pivotal mounting includes an arrangement whereby pivot pin 42 is received in horizontally extending bores 37 located at the rearward ends of the vertical sides 35 of jig member 34. As is shown in FIG. 6, jig member 34 can pivot between the solid and dashed line positions shown in a generally vertical direction.

There is provided means for holding the head 10 of a golf club wood in a fixed position at the free end of jig member 34 so that the face 12 of the head 10 is movable through a circular arc centered on the pivotal axis of pivot pin 42, said circular arc having a preset radius of ten inches. This holding means comprises a support block 50 located at the free end of jig member 34 and having an upwardly facing surface 52 shaped to receive the sole plate 16 on the bottom of the head 10 in a form-fitted supporting position. Support block 50 is made of an epoxy mold which assumes a deformable condition when heated to an elevated temperature so that the surface 52 thereof can be form-fitted to the shape of the sole plate 16 of the head 10 of the golf club wood to be finished. Support block 50 is contained between the vertical sides 35 and base 33 of jig member 34 at the free end thereof and between a plate 54 extending transversely between sides 35 as is shown in FIG. 6. The surface 52 is generally flat and extends at a small acute angle to the base 33 of jig member 34, this acute angle being used to accommodate the loft angle of the golf club as will be described hereafter.

The holding means for the head 10 also includes a plurality of positioning screws 56 extending upwardly through the base 33 of jig member 34 and the support block 50 to project upwardly from the support block surface 52 a small amount so as to engage the sole plate 16 of the head 10 (FIG. 7) at conical points 58 at their ends. The four positioning screws 56 are threadedly received in threaded bores 57 in base 33 and are arranged and oriented so that their projecting points 58 come into contact with the heads of four mounting screws 17 which secure the sole plate 16 to the bottom of the head 10. Generally the arrangement of these four mounting screws is conventional for a particular set of woods. Positioning screws 56 serve to both support head 10 and locate head 10 at the precise position for finishing face 12.

The means for holding the head 10 on the jig member 34 also comprises a clamping means adapted to contact the top 18 of the head 10 to urge the head 10 downwardly toward the supporting surface 52 of support block 50. This clamping means includes a conventional over-center clamping device 60 which comprises a handle 61 connected at pins 62 and 64 to a pair of links 63 and 65, respectively. Links 63 and 65 are pivotally mounted on a base 66 at pivot pins 67 and 68, respectively. Base 66 is mounted on a support block 59 secured by four screws onto the base 33 of jig member 34 rearwardly of the support block 50 as shown in the Drawings. Link 65 has a forwardly projecting portion which extends toward the sanding member 38 and to overlie the surface 52 of block 50 as is best shown in FIGS. 5 and 6. Link 65 carries a threaded pin 45 which is adjustably mounted thereon by means of a pair of nuts 46 and associated lock washers. The adjustable pin 45 extends generally perpendicularly toward the base 33 of jig member 34 and carries at its lower end a flexible pad 48 adapted to contact the top 18 of the head 10 so as to provide good contact therewith and to urge head 10 downwardly without damaging the surface thereof.

Jig means 32 comprises an elongated carriage 70 extending horizontally across the top horizontal surface of base 30. As stated above, the uprights 40 and pivot pin 42 are arranged to support the jig member 34 to be pivotally mounted at the rearward end of the carriage 70. An upright post 69 is mounted at the forward end of carriage 70 to provide a stop or support limiting the downward movement of the free end of the jig member 34.

Means are provided for guiding jig means 32 for movement on base 30 toward sanding member 38 to present the head face 12 into contact with the sanding surface 39 thereof for finishing the surface of face 12 with bulge and roll face curvatures. Such guide means comprises a pair of guide members 72 and 74 cooperating with carriage member 70 to guide the same for movement along a path extending generally perpendicular to the axis of rotation of sanding member 38, said axis of rotation extending generally horizontally and in parallel relation to the pivotal axis of pivot pin 42 as is apparent from the Drawings. The guide members 72 and 74 are provided with spaced apart parallel recessed portions 73 and 75, respectively, as shown in FIG. 8, adapted to slidably receive the side edges of the carriage 70 for confining the movement thereof in said horizontal path. Guide members 72 and 74 have uprights 71 and 77, respectively, mounted thereon arranged to guide the free end of jig member 34 in its vertical and horizontal movement.

There is provided means for feeding the carriage 70 in gradual increments toward sanding member 38. This feeding means includes a screw feed means having a first threaded member in the form of a threaded nut 76 mounted fixedly on carriage 70 at the forward end thereof (FIG. 6). The screw means also comprises a second threaded member in the form of a long pin 78 rotatably mounted at one end in a bearing support 80 at the end of base 30, as is best shown in FIG. 6. The pin 78 extends from the bearing support 80 under sanding member 38 and is provided with a threaded end threadedly received in the nut 76. The end of the pin 78 in bearing support 80 has a knob 82 secured thereto for causing rotation of pin 78 about its longitudinal axis.

The parts are constructed and arranged so that the manual rotation of knob 82 will cause rotation of pin 78 whereby the threaded end thereof will cooperate with nut 76 to cause the carriage 70, and the jig means 32 mounted thereon, to move toward the sanding member 38 in small steps or gradual increments as desired and as will be described more fully hereafter.

Sanding member 38 has a concave sanding surface 39 the radius of curvature of which is set to be equal to the radius of curvature of the desired bulge curvature which, as shown in FIG. 3, is typically twelve inches. Sanding member 38 is comprised of a cylindrical roller having sandpaper secured on its outer concave surface, the sandpaper having an appropriate degree of coarseness as required for the particular sanding application.

There are provided means for mounting sanding member 38 for rotation about a horizontal axis that is parallel to the pivotal axis of the pivot pin 42, about which jig member 34 is pivoted. To this end, there is provided a drive shaft 86 extending along the central longitudinal axis of the roller forming sanding member 38 and extending laterally outwardly therefrom to be received in journal bearings 88 and 90 mounted on upright supports 89 and 91, respectively, which are secured to a horizontal support 92 mounted on base 30 by suitable mounting means (not shown). At one end, the drive shaft 86 extends outwardly from its journal bearing 88 to a coupling means 94 which serves to couple the drive shaft 86 to the output shaft 96 of an electric motor 98. By this arrangement, operation of the electric motor 98 causes rotation of sanding member 38 about its horizontal axis of rotation by means of the connection provided by the coupling means 94, as is best shown in FIGS. 4 and 8.

There is provided a hood means 100 arranged to enclose a substantial portion of the sanding member 38 and means for applying a vacuum pressure to the interior of the hood means 100 for withdrawing dust-like particles from the vicinity of the sanding member 38. The means for applying the vacuum pressure comprises a duct member 102 which is connected to a conduit 104 which is, in turn, connected to the vacuum source 106 shown diagrammatically in FIG. 5. In the Drawings, the hood means 100 is shown in diagrammatic and dashed form for clarity of illustration of the major parts of the apparatus.

The use of the apparatus shown in FIGS. 4–9 for finishing the face of the head of a golf club wood with preset bulge and roll face curvatures will now be described.

The head 10 is prepared initially with a loft angle formed thereon, with the insert 22 held in position in the recess formed in face 12 by epoxy glue, and with the sole plate 16 mounted on the bottom of head 10 by means of the four mounting screws 17. At this stage the loft angle is approximate to the angle desired, i.e., eleven degrees. FIG. 2 shows the head 10 in this stage of completion. The insert 22 is then permanently secured to the head 10 by means of six headless screws 26. The head 10 is now prepared in a condition to have the face 12 finished with bulge and roll face curvatures of twelve inches and ten inches, respectively, and with a loft angle of eleven degrees.

The first step in the finishing operation is to mount the head 10 on the free end of jig member 34 in a position as shown in FIGS. 5–9. The exact position of head 10 in jig member 34 is very important and, as best shown in FIGS. 5, 6 and 8, the head 10 is positioned to be held in a fixed position on jig member 34 at the free end thereof so that the face 12 of head 10 is movable through a circular arc centered on the pivotal axis of pivot pin 42 and to have a predetermined radius of ten inches. More specifically, the mounted position is such that face 12 is generally in a plane that is tangent to said circular arc and also positioned so that this plane of face 12 is square relative to the sanding surface 39 of sanding member 38 when the jig means 32 is moved to the sanding position as described hereafter.

The mounting of head 10 is achieved by opening the overcenter clamping means 60 by pushing down handle 61 which moves pin 45 away from surface 52 of support block 50 to provide substantial space to allow the head 10 to be placed onto the surface 52. As was discussed above, surface 52 is form-fitted to receive the sole plate of head 10. Head 10 is located in a precise position by the four positioning screws 56 whose conical tips engage the heads of the four mounting screws 17 for sole plate 16. The handle 61 of the overcenter clamping means 60 is then pushed downwardly to secure the head 10 in position. At this point screws 56 may be further adjusted to set the face 12 to a more precise position to achieve the desired tangent condition and loft angle as discussed above.

The jig means 32 is then slid along the guide means toward the sanding means 36 to provide for engagement between the threaded end of pin 78 and nut 76 to a position such as shown in FIG. 6. The jig means 32 can then be advanced toward the sanding member 38 under the control of the screw feed means and, more specifically, by rotation of knob 82 to cause a rotation of the long pin 78 as described above. During a sanding operation, the operator manually advances the face of head 10 into sanding contact with surface 39 of sanding member 38 which is rotating by reason of the operation of the motor 98. At the same time, that the sanding is occurring, the operator lifts and lowers the free end of jig member 34, such as between the solid and dashed-lined positions shown in FIG. 6. By this operation the operator performs the simultaneous sanding of both the bulge and the roll face curvatures. The operator very carefully performs repeated feeding and lifting and lowering steps until it is determined that the preset bulge and roll curvatures have been achieved with the desired smoothness and finish.

By reason of the above-described operation and the construction of the apparatus in accordance with the invention, the desired bulge and roll radii are preset in the apparatus so that they can be achieved with a high degree of accuracy.

It will be apparent that various changes may be made in the construction and arrangement of the apparatus in accordance with the invention without departing from the scope of the invention. For example, while the apparatus preferably employs a sanding means for performing the finishing operation. Other forming or abrading means may be used, such as a grinder or the like. Thus, the term "abrading" as used herein is intended to cover various material forming devices such as sanders, grinders or the like.

What is claimed is:

1. An apparatus for finishing the face of the head of a golf club wood with bulge and roll face curvatures comprising:

a base, a jig means movably mounted on said base, a jig member mounted on said jig means for movement therewith, means for mounting said jig member on said jig means for pivotal movement about a pivotal axis, means for holding the head of a golf club wood in a fixed position on said jig member at a free end thereof so that the face of the head is movable through a circular arc centered on said pivotal axis and having a predetermined radius, means for sanding the face of said head as it moves through said circular arc including a rotating sanding member mounted for rotation about an axis of rotation and having a concave sanding surface having a predetermined radius of curvature, means for guiding said jig means for movement on said base toward said sanding member to present the head face into contact with said concave sanding surface for finishing the face surface with bulge and roll face curvatures, the radius of curvature of said concave sanding surface being equal to the radius of curvature of said bulge face curvature of the head face, and the radius of said circular arc through which the head face is movable on said jig member being equal to the radius of curvature of said roll face curvature of the head face.

2. An apparatus according to claim 1 wherein said jig member is pivotally mounted at one end thereof and extends from said pivoted end a substantial distance to a free end located adjacent said sanding member, said means for holding the golf club wood in said jig member including a support block having a surface shaped to receive a sole plate on the bottom of the head of the golf club wood in a form-fitted supporting position, said support block being located at the free end of said jig member, and clamping means adapted to contact the top portion of the head of the golf club wood and urge the same toward said support block surface.

3. An apparatus according to claim 2 wherein said means for holding the head of the golf club wood on said jig member includes a plurality of positioning screws extending through said support block to project from said support block surface into engagement with the sole plate of the head of the golf club wood.

4. An apparatus according to claim 2 wherein said clamping means includes an over-center clamping device having a flexible pad at an end thereof for contacting the top portion of the head of the golf club wood.

5. An apparatus according to claim 2 wherein said support block is made of an epoxy mold which assumes a deformable condition when heated to an elevated temperature whereby the surface thereof can be form-fitted to the shape of the sole plate of the golf club wood.

6. An apparatus according to claim 1 wherein said jig means includes an elongated carriage member, said jig member being pivotally mounted at the end of said carriage member remote from said sanding member, said means for guiding said jig means for movement on said base comprising guide members cooperating with said carriage member to guide the same for movement along a path extending generally perpendicular to the axis of rotation of said sanding member.

7. An apparatus according to claim 6 including means for feeding said carriage member in gradual increments toward said sanding member including screw feed means having a first threaded member mounted on said carriage member and a second threaded member mounted on said base and threadedly engaged with said first threaded member.

8. An apparatus according to claim 1 wherein said sanding member comprises a cylindrical roller having sandpaper secured on its concave outer surface, and including means for mounting said roller for rotation about an axis parallel to the pivotal axis of said jig member.

9. An apparatus according to claim 8 wherein said cylindrical roller has a drive shaft located on the axis of rotation thereof, and including a motor operatively connected to said drive shaft for causing rotation of said roller about said axis of rotation thereof.

10. An apparatus according to claim 1 including hood means enclosing a substantial portion of said sanding means, and means for applying a vacuum pressure to the interior of said hood means for withdrawing dust-like particles from the vicinity of said sanding means.

11. An apparatus according to claim 1 wherein said pivotal axis of said jig member extends generally horizontally, said axis of rotation of said sanding member being parallel to said pivotal axis of said jig member and spaced therefrom along said base, said guide means being constructed and arranged to guide said jig means in a generally horizontal path, and said circular arc through which the face of said golf club head is movable extends in a generally vertical direction.

12. An apparatus for finishing the face of the head of a golf club wood with bulge and roll face curvatures comprising:

a base, a jig means movably mounted on said base, a jig member mounted on said jig means for movement therewith, means for mounting said jig member on said jig means for pivotal movement about a pivotal axis, means for holding the head of a golf club wood in a fixed position on said jig member at a free end thereof so that the face of the head is movable through a circular arc centered on said pivotal axis and having a predetermined radius, means for abrading the face of said head as it moves through said circular arc including a rotating abrading member mounted for rotation about an axis of rotation and having a concave abrading surface having a predetermined radius of curvature, means for guiding said jig means for movement on said base toward said abrading member to present the head face into contact with said concave abrading surface for finishing the face surface with bulge and roll face curvatures, the radius of curvature of said concave abrading surface being equal to the radius of curvature of said bulge face curvature of the head face, and the radius of said circular arc through which the head face is movable on said jig member being equal to the radius of curvature of said roll face curvature of the head face.

13. An apparatus according to claim 12 wherein said jig member is pivotally mounted at one end thereof and extends from said pivoted end a substantial distance to a free end located adjacent said sanding member, said means for holding the golf club wood in said jig member including a support block located at the free end of said jig member, and clamping means adapted to contact the top portion of the head of the golf club wood and urge the same toward said support block.

14. An apparatus according to claim 13 wherein said means for holding the head of the golf club wood on said jig member includes a plurality of positioning screws extending through said support block to project from the surface of said support block into engagement with the sole plate of the head of the golf club wood.

15. An apparatus according to claim 12 wherein said jig means includes an elongated carriage member, said jig member being pivotally mounted at the end of said carriage member remote from said sanding member, said means for guiding said jig means for movement on said base comprising guide members cooperating with said carriage member to guide the same for movement along a path extending generally perpendicular to the axis of rotation of said sanding member.

16. An apparatus according to claim 15 including means for feeding said carriage member in gradual increments toward said sanding member including screw feed means having a first threaded member mounted on said carriage member and a second threaded member mounted on said base and threadedly engaged with said first threaded member.

17. An apparatus according to claim 12 wherein said abrading member comprises a cylindrical roller having sandpaper secured on its concave outer surface, and including means for mounting said roller for rotation about an axis parallel to the pivotal axis of said jig member.

18. An apparatus according to claim 17 wherein said cylindrical roller has a drive shaft located on the axis of rotation thereof, and including a motor operatively connected to said drive shaft for causing rotation of said roller about said axis of rotation thereof.

* * * * *